US011713166B2

(12) United States Patent
Avolio et al.

(10) Patent No.: US 11,713,166 B2
(45) Date of Patent: Aug. 1, 2023

(54) LOW MIGRATION CONTAINER

(71) Applicant: CROWN PACKAGING TECHNOLOGY, INC., Alsip, IL (US)

(72) Inventors: Salvatore Avolio, Oxfordshire (GB); Gerald Nadin, Oxfordshire (GB); Christopher Paul Ramsey, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 17/312,076

(22) PCT Filed: Nov. 13, 2019

(86) PCT No.: PCT/GB2019/053221
§ 371 (c)(1),
(2) Date: Jun. 9, 2021

(87) PCT Pub. No.: WO2020/128415
PCT Pub. Date: Jun. 25, 2020

(65) Prior Publication Data

US 2022/0024646 A1 Jan. 27, 2022

(30) Foreign Application Priority Data

Dec. 17, 2018 (GB) ..... 1820548

(51) Int. Cl.
*B65D 41/04* (2006.01)
*B65D 1/10* (2006.01)
*B65D 53/02* (2006.01)

(52) U.S. Cl.
CPC ..... *B65D 41/0457* (2013.01); *B65D 1/10* (2013.01); *B65D 53/02* (2013.01)

(58) Field of Classification Search
CPC ..... B65D 41/0457; B65D 1/10; B65D 53/02
See application file for complete search history.

(56) References Cited

U.S. PATENT DOCUMENTS

| | | | |
|---|---|---|---|
| 2,552,491 | A | 5/1951 | Marks et al. |
| 4,000,825 | A | 1/1977 | Westfall |
| 6,399,170 | B1 | 6/2002 | Hock et al. |

(Continued)

FOREIGN PATENT DOCUMENTS

| | | | |
|---|---|---|---|
| CN | 1225327 | A | 8/1999 |
| CN | 103466186 | A | 12/2013 |

(Continued)

*Primary Examiner* — Shawn M Braden
(74) *Attorney, Agent, or Firm* — Condo Roccia Koptiw LLP

(57) ABSTRACT

A container comprising a container body having a neck, the neck having inner and outer surfaces and a rim extending between tops of the inner and outer surfaces, and the rim defining a circular opening. The closure has a centre panel, the closure defining an annular channel. An annular gasket is disposed in the annular channel and the annular channel receives said rim of said neck such that the annular gasket forms a seal between said rim and said closure. When the container body is closed by the closure, the difference between an inside radius of the annular channel at a channel depth of 0.2 mm and an inside radius of said rim is less than substantially 0.9 mm.

19 Claims, 10 Drawing Sheets

(56) References Cited

U.S. PATENT DOCUMENTS

| | | | | |
|---|---|---|---|---|
| 2010/0003109 | A1* | 1/2010 | Ramsey | B21D 51/44 413/8 |
| 2015/0028035 | A1 | 1/2015 | Maengel | |
| 2018/0282027 | A1* | 10/2018 | Robles González | B65D 41/325 |
| 2018/0346205 | A1* | 12/2018 | Szczesniak | B65D 41/0457 |

FOREIGN PATENT DOCUMENTS

| | | | |
|---|---|---|---|
| EP | 0155021 | B1 | 5/1988 |
| GB | 2409447 | A | 6/2005 |
| GB | 2552491 | A | 1/2018 |
| JP | S60204473 | A | 10/1985 |
| JP | 2545207 | Y2 | 10/1996 |
| WO | 2002064432 | A2 | 8/2002 |

* cited by examiner

LOW MIGRATION CONTAINER

CROSS-REFERENCE TO RELATED APPLICATIONS

This application is the National Stage of International Application No. PCT/GB2019/053221, filed Nov. 13, 2019, which claims the benefit of GB application number 1820548.4, filed Dec. 17, 2018, the disclosures of which are incorporated herein by reference in their entirety.

TECHNICAL FIELD

The present invention relates to a container offering reduced additive migration and having a container body and a twist-on or push-on-twist-off closure, and to a method for closing such a container.

BACKGROUND

Gaskets provide a seal between two or more mating surfaces to prevent leakage from or into the joined objects while under compression. They compensate for less-than-perfect mating surfaces as they can fill any irregularities which might otherwise prevent a good seal from forming. In the food and beverage packaging industry, gaskets are often used to provide a seal between container bodies, such as glass or rigid plastic jars or bottles, and lids or caps (which also may be made of metal or a rigid plastic), which are referred to here as "closures". Modern metal closures typically fall into two categories; twist-on-twist-off closures and press-on-twist-off closures.

Twist-on-twist-off closures are formed with lugs or threads that engage with a thread (or lugs) formed around the neck of the container body. During production, immediately after filling, the closure is applied by twisting it onto the container body. A consumer opens the container by twisting the closure in the opposite direction.

In the case of a press-on-twist-off closure, the closure is not provided with lugs or a thread. Rather, the gasket material is also applied to the inner surface of the closure sidewall. Following filling, the closure is pressed onto the container body. The gasket material on the sidewall flows over the thread or lugs formed on the container body neck (on closure or during a subsequent pasteurisation process), and subsequently sets such that threads or "lugs" are formed in the gasket material. These allow a consumer to subsequently remove the closure by twisting, i.e. the closure is applied during production by pressing-on, and is subsequently removed by twisting-off.

Closures can have different diameters such as those according to international closure standards which include, for example, diameters of 30, 33, 38, 43, 48, 53, 58, 63, 66, 70, 77, 82, 89, 100, 110 mm. A commonly used closure diameter is 63 mm.

A number of known closure geometries are illustrated in FIGS. 1*a*-1*g*.

FIG. 1*a* illustrates a stepped-button-type closure 101*a*. An annular channel 102*a* is formed in the closure in which gasket 103*a* is disposed. The annular channel 102 has a step 104*a* around its outer radius.

FIG. 1*b* illustrates a button-type closure 101*b* which is similar to the closure of FIG. 1*a* but does not have the same step formed at the outer radius of its annular channel 102*b*. The gasket 103*b* is thus free to extend partly down the wall 104*b* of the closure 101*b*.

FIG. 1*c* illustrates a closure 101*c* which has a frusto-conical outer region 102*c* which reduces metal usage.

FIG. 1*d* illustrates a closure which is typically manufactured in 40 mm and 63 mm diameter sizes and has a composite design with a plastic threaded band 101*d* and metal panel 102*d* in which the annular channel is formed.

FIG. 1*e* illustrates a closure having a sidewall made up of a lugged plastic band 101*e* and metal panel 102*e* in which the annular channel is formed. The closure of FIG. 1*e* typically has a diameter of 58 mm, 72 mm, or 77 mm.

FIG. 1*f* illustrates a closure which is a two piece steel closure with a sidewall made up of a lugged band 102*e* and metal panel 101*f* in which the annular channel is formed. The closure of FIG. 1*f* typically has a diameter of 70 mm or 82 mm.

FIG. 1*g* illustrates what is known as a continuous thread closure 101*g*. It has a thread 102*g* which engages with matching a thread in the annular neck of a container body (e.g. a glass jar). Continuous thread closures are typically used in the home canning market and are designed to vent during pasteurisation such that, when cooled, a strong vacuum is formed which pulls the closure onto the container body to maintain a good seal. Continuous thread closures typically use a soft gasket compound which is foamed and is particularly sensitive to additive migration due to the blowing agent contained therein. Continuous thread closures typically have diameters of 43 mm, 48 mm, 56 mm, 58 mm, 63 mm, 70 mm, 77 mm, 83 mm, 86 mm, 89 mm, or 100 mm.

FIG. 2*a* shows a schematic cross-sectional view of a portion of a known closure 201, of the type shown in FIG. 1*a*, and a container body neck 202*a* defining a rim 202 at its top. The capping process has not yet been completed so the compound 203*a* from which the gasket is formed has not yet been pressed onto the rim 202. In this state, the maximum gasket compound thickness is approximately 1.0 mm, directly above the middle of the rim 202. FIG. 2*b* shows a schematic cross-sectional view of the closure 201 and container body neck 202*a* with the capping and processing completed. After capping, the compound 203*a* has formed gasket 203*b* and is pressed against the rim 202, causing it to deform slightly to match the shape of the rim 202 and thereby create a good seal. In this state, the maximum thickness of the gasket is approximately 0.5 mm. In order to prevent the metal of the closure 201 from contacting the inside of the rim 202, the inside radius of the gasket 203*b* is always at least 1.2 mm smaller than the inside radius of the rim 202.

Capping (i.e. the process of closing a container body with a closure) occurs after container bodies are filled with a product. Closures are applied to the container bodies on a high speed in-line capping machine at typically around 400 closures per minute. The closures are heated to around 100° C. in the capping chute of the capping machine which softens the compound 203*a* from which the gasket is formed. In the case of twist-on-twist-off closures, the closures are then twisted onto the container bodies by the capping machine which causes lugs 204 to engage with a thread 205 on the container body neck. This pulls the closure down onto the rim 202. An axial load is also normally applied by belts on the capping machine during the capping process. As the softened gasket compound is compressed, it flows over both sides of the rim 202, leaving the above described residual thickness of around 0.5 mm.

Polyvinyl chloride (PVC) is a plastic polymer which has been used in gaskets in the food container industry. The properties of PVC can be altered by additives such as a plasticiser, which can increase the flexibility, softness, lubricity and elongation of the PVC. Plasticisers are normally high-boiling point, chemically and thermally stable organic liquids. External plasticisation is achieved by the plasticiser's physical interaction with the polymer to which it has been added, which reduces mutual attractive forces between polymer chains. Plasticisers are relatively poor solvents for PVC resins at room temperature, permitting good viscosity stability. They exhibit sufficiently strong solvating properties at elevated temperature allowing them to rapidly dissolve or "fuse" PVC resin.

"Plastisol" is a suspension of PVC resin in a liquid plasticiser to produce a fluid mixture which can range in viscosity from a pourable liquid to a heavy paste. It represents a typical form of plasticised PVC. Fillers, stabilisers, modifiers, pigments and other compounding ingredients may also be added to plasticiser. PVC has semi-crystalline zones which are less easily plasticised than amorphous regions which are heterogeneous. Ordered zones reduce thermoplasticity of PVC and help it resist flow under sterilisation conditions and contribute some rubber character to the plastisol.

When plastisol is exposed to heat during curing, it is converted into a homogeneous product. The heat causes the suspended PVC resin to be fused or dissolved in the plasticiser. Upon cooling, a flexible, solid vinyl product is formed. As the liquid plastisol is heated, plasticiser enters voids in the constituents of the mixture and starts the process of solvation and/or swelling of individual PVC particles to form a homogeneous structure. If the heating process continues up to the PVC glass transition temperature, PVC particles absorb the plasticiser to such an extent that the plastisol becomes a solid paste. Above the PVC glass transition temperature, the solid paste acquires a gel structure which involves total plasticiser absorption. At this stage, the material has a solid consistency but poor particle cohesion and, consequently, its mechanical properties are poor for use as a gasket. It is necessary to reach temperatures above 190° C. to produce a fusion of PVC micro crystallites which are necessary to form, together with absorbed plasticiser, a homogeneous matrix. Once this structure is cooled the plastisol is a solid material with very high particle cohesion and flexibility which may be suitable for use as a gasket.

The sealing performances of the closures are dependent on the physical properties of the sealing gasket, which are strongly determined by the chemical composition of the plasticisers used therein. Essential selection criteria regarding the suitability of plasticisers in food containers include low plasticiser volatility, low plastisol viscosity, PVC compatibility, softness and resilience as well as non-toxicity and high plasticiser migration resistance.

Typically, gaskets comprise 0.5-1.5 g of plastisol. Plastisols usually contain 35-45% by weight of plasticiser. In addition, they contain approximately 0.2-1% of PVC stabilisers to endure the heat treatment experienced during curing, 1-3% of slip agents (such as fatty acids amides including Erucamide and Oleamide) to facilitate opening of the closure, lubricants such as silicone, and pigments such as titanium dioxide. After capping, only the gasket material oriented towards the centre of the closure is in contact with the contents of the container.

The final, cured material of the gasket has to be soft to give good sealing. For example, a hardness range of approximately between 50 to 80 Shore on the Shore A hardness scale will provide a good seal. After the container has been sealed, typically a vacuum (generated by product cooling) of around 10 inHg (approximately 33.77 kPa) or greater in the container may pull the closure down onto the container body to compress the gasket and maintain the seal. These closures are therefore known as vacuum closures.

During closure production, plastisol is flowed into an annular channel on the underside of the closure. Typically this is achieved by rotating the closure on a chuck (at around 1000 rpm) and applying the plastisol using a dispensing gun over a series of revolutions of the closure. The channel ensures the plastisol remains positioned correctly as the closure spins: it is desirable that the plastisol is not too viscous so as to avoid a step-like shape in its profile. After application of the plastisol to the closure, the closure is heated in an oven for approximately 60-90 seconds at 190-220° C. depending on the formulation of the plastisol in order to cure it. PVC free based materials are normally 'in-shell' compression moulded and are generally based on thermoplastic elastomers (TPE).

In the last 10-15 years, PVC compositions used in gaskets for food and beverage containers have been subjected to substantial reformulation in order to try to address one of the main problems they suffer from: additive migration. In particular, additives such as plasticiser migrate from the gasket into the contents in the container. This may be particularly problematic if the plasticiser has toxic properties.

Additive migration is not a continuous process but occurs in steps. FIG. 3 shows schematically a cross-sectional view of part of a known closure 303 of the type shown in FIG. 1*a* and a container body neck 302 and between which a gasket 303 provides sealing. During a first step, whenever the contents of the container come into contact with the gasket 303, a small amount of oil or paste 303 adheres to it. The additives migrate from the gasket 303 into this oil or paste 303 and may build up in a high concentration there. Migration may approach or reach equilibrium, slowing or actually stopping the transfer process. Secondly, upon shaking of the container, for example during transport, this oil or paste 304 may be displaced, transporting the migrate into the container contents 305 and bringing new oil or paste into contact with the gasket 304. This exchange of migrate and container contents is shown by arrows 401 in FIG. 4.

In order to measure additive migration, a container body is filled with a food simulant (such as vegetable oil) and the container body (such as a glass jar) is capped with a closure. The container body is turned upside down to bring the food simulant into contact with the gasket. The container body is then heated at a sequence of different temperatures for a set time. At the end of the test, the food simulant is analysed to determine the levels of specific additives (e.g. plasticisers) that have migrated from the gasket into the food simulant, or alternatively, the weight loss of the closure may be measured to determine overall migration from the gasket into the food by weight.

Previous attempts to address additive migration by reformulating the gasket composition have involved partial or total replacement of some plasticisers, for example replacing phthalates with polyadipates which have a less toxic profile and a high migration resistance. However, gasket compositions are often tailored for specific applications so it is not always possible to address additive migration by reformulation. For example, some closure shapes and types may require a gasket with specific mechanical characteristics, some thermal food processes (e.g. pasteurisation/sterilisation) require a gasket with specific thermal and/or mechanical resistances, and some food products (e.g. oily or aqueous foods) require a gasket with specific chemical resistances. In the case where a product in a container is particularly oily with high chemical affinity, additive migration tends to be higher. Even where a product in a container is not particularly oily (e.g. in the case of foods having less than 5% free oil or fats), a significant level of additive migration will still occur due to the lipophilic character of the compound used to form the gasket. Indeed any amount of free oil or fat is sufficient to extract the plasticisers from the gasket during food processing, transport and storage. Only when a product in a container is purely aqueous (such as when the product is marmalade or pickles), or where the product never comes into contact with the gasket (such as when it is a solid so that does not lose its shape when the container is moved), is additive migration not considered to be a significant problem.

It is challenging to balance all of these requirements and provide a low migration compound by reformulation which will reduce migration to an acceptable level across a variety of applications.

In any case, even where reformulations have helped to at least partially mitigate the migration problem by reducing the total amount of plasticiser in gaskets, they typically come at the cost of increased production complexity (for example increased plastisol viscosity that requires systems to warm up the composition when lining the inside of the closure with it), decreased production line efficiency (for example increasing the frequency with which plastisol mixtures need to be removed and replaced on a production line for a given application), and higher raw material costs.

Other attempts to address the issue of additive migration have involved foaming the gasket during formation using a blowing agent such as bicarbonate to reduce the total plastisol required and thereby to reduce the total additive present in the gasket. Sodium bicarbonate is endothermic (adsorbing heat) and produces the following reaction during decomposition when cured ($2NaHCO3 \rightarrow Na2O+CO2+H2O$). Sodium bicarbonate typically activates at around 145° C. and completes at 165° C. Prior to its use, Azodicarbonamide (ADC) was the preferred choice of blowing agent in Europe, however it was banned as a food approved material in 2005, owing to concern over the release of semicarbazide (a metabolite) during its decomposition. ADC, by contrast is exothermic (releasing heat) and provided superior performance to the plastisol than sodium bicarbonate. Its use is still permitted in the USA.

There is a need for an alternative way to address the problem of additive migration.

SUMMARY

According to a first aspect of the invention there is provided a container comprising a container body having a neck, the neck having inner and outer surfaces and a rim extending between tops of the inner and outer surfaces. The rim defines a circular opening. The container comprises a closure having a centre panel. The closure defines an annular channel. An annular gasket is disposed in the annular channel. The annular channel receives said rim of said neck such that the annular gasket forms a seal between said rim and said closure. When the container body is closed by the closure, the difference between an inside radius of the annular channel at a channel depth of 0.2 mm and an inside radius of said rim is less than substantially 0.9 mm.

An inside radius of the annular gasket may be greater than a radius that is equal to an inside radius of said rim less substantially 0.9 mm.

A thread may be provided on the outer surface of the neck, and the closure may comprise a sidewall provided with lugs for engaging with said thread. The annular channel maybe defined between the centre panel and the sidewall The rim may comprise a substantially continuously curved region connected to one or both of the inner and outer surfaces by a lip or lips.

The inside radius of the annular gasket may be greater than a radius that is equal to the inside radius of said rim less substantially 0.8 mm.

An inside radius of the annular channel at a channel depth of 0.2 mm may be greater than a radius that is equal to an inside radius of said rim less substantially 0.8 mm.

The inside radius of the annular gasket may be greater than the inside radius of the rim.

When the container body is closed by the closure, a portion of the annular gasket may be exposed to a volume enclosed by the container body, and a radial dimension of the exposed portion may be less than 1.2 mm or less than 1.0 mm.

When the container body is closed by the closure, a first portion of the closure may contact said rim to limit exposure of the annular gasket to a volume enclosed by the container body. A portion of the annular gasket may be exposed to the volume enclosed by the container body, and a radial dimension of the exposed portion may be less than 0.1 mm.

When the container body is closed by the closure, the difference between the inside radius of the annular gasket and a radius at the centre of the rim may be less than 2.3 mm or less than 2.1 mm.

The mass of the annular gasket per mm of width of the annular gasket may be less than 8 mg/mm or less than 6.4 mg/mm.

A lower end of the sidewall may be curled inwardly and said lugs may be formed by varying the radius of curvature of the curl around the circumference of the closure.

The annular gasket may be formed of plastisol.

The closure may be a vacuum closure.

The annular gasket may comprise a compression moulded thermoplastic elastomer.

According to a second aspect of the invention there is provided a method of forming the above described closure comprising flowing heated plastisol into the annular channel, and allowing the heated plastisol to settle and cool under gravity.

According to a third aspect of the invention there is provided a container comprising a container body having a neck, the neck having inner and outer surfaces and a rim extending between tops of the inner and outer surfaces. The rim defines a circular opening, and a thread on the outer surface of the neck. The container comprises a closure having a centre panel and a depending sidewall, the closure defining an annular channel between the centre panel and the sidewall. An annular gasket is disposed partially in the annular channel and partially on the inside of the sidewall for engaging with said thread. The annular channel receives said rim of said neck such that the annular gasket forms a seal between said rim and said closure. When the container body is closed by the closure, an inside radius of the annular gasket is greater than an inside radius of said rim.

Said rim may comprise a substantially flat upper surface region connected to one or both of the inner and outer surfaces by a lip or lips beneath said flat surface region.

When the container body is closed by the closure, a first portion of said annular channel may be in direct mechanical contact with said rim to prevent exposure of the annular gasket to a volume enclosed by the container body. A portion of the annular gasket may be exposed to the volume enclosed by the container body, and a radial dimension of the exposed portion may be less than 0.1 mm.

The annular gasket may be formed of plastisol.

The annular gasket may comprise a compression moulded thermoplastic elastomer.

The closure may be a vacuum closure.

DETAILED DESCRIPTION

The problems of additive migration in the context of container gaskets, and the shortcomings of attempts to address these, have been discussed above with reference to FIGS. 1 to 4. Alternative way to address additive migration will now be described with reference to FIGS. 5 to 13.

Figure 5A:
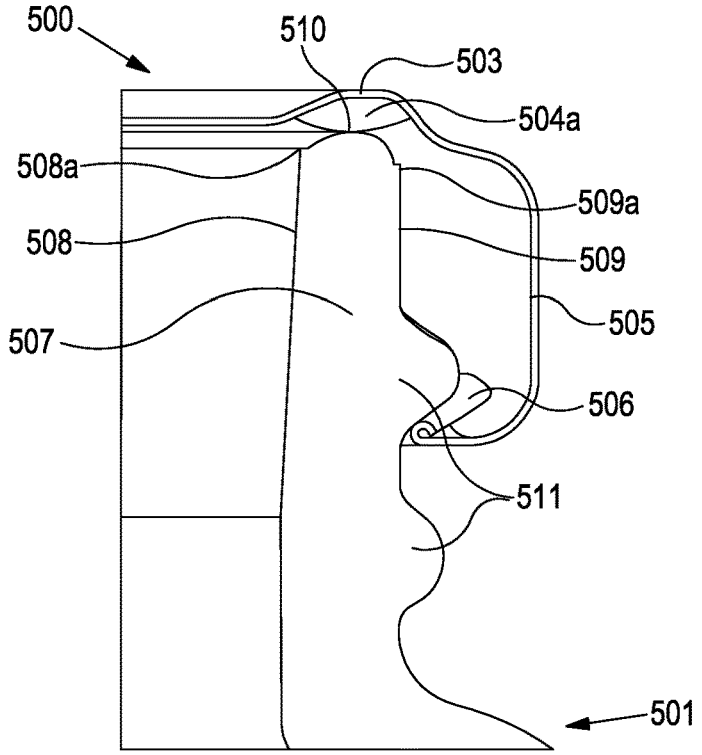
FIG. 5*a* shows a cross-sectional view of part of a twist-on closure and container body neck of a container according to an embodiment before capping.

FIG. 5*a* is a cross-sectional view of a portion of a closure 500 and a container body 501, where the closure has been placed on the container body but has not been twisted on. The closure comprises a centre panel 502 and a depending sidewall 505 provided with lugs 506. An annular channel 503 is defined in the closure between the centre panel 502 and the sidewall 505. A compound 504*a* suitable for forming a gasket is disposed in the annular channel 503. The lugs 506 are formed by curling the end of the sidewall 505 inwards and varying the radius of curvature of the curl along sections of the circumference. The closure 500 is circular so that it may be twisted on and off the container body 501 (i.e. the closure is said to be a twist-on-twist-off closure). The annular channel 503 and the compound 504*a* disposed therein extend entirely around the circumference of the closure 500.

The container body 501 has a neck 507, the neck having an inner surface 508 and an outer surface 509, and a rim 510 extending between the tops 508*a*, 509*a* of the inner and outer surfaces. The rim 510 defines a circular opening and is shaped so that it can be received in the annular channel 503 in which the gasket compound 504*a* is disposed. In particular, the rim 510 may be at least partly rounded to avoid sharp edges and ensure good contact with the closure 502 and/or gasket after capping. In FIG. 5*a*, the rim 510 is rounded and joins the tops 508*a*, 509*a* of both the inner surface 508 and outer surface 509 with respective lips. Thread sections 511 are formed on the outer surface 509 of the neck 507 and are shaped to engage with the lugs 506.

Figure 5B:
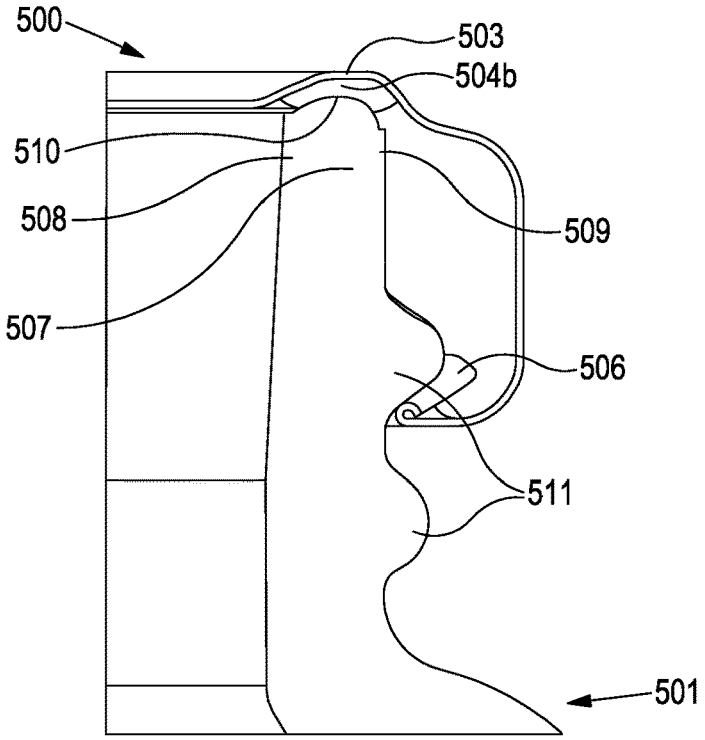
FIG. 5*b* shows a cross-sectional view of the closure and container body neck of FIG. 5*a* after capping.

FIG. 5*b* shows a cross-sectional view of a portion of the closure 500 and the container body 501 of FIG. 5*a* after undergoing capping. During the capping process, the closure 500 is twisted down onto the rim 510 while the annular channel 503 in which compound 504*a* is disposed is in alignment with the rim 510. This causes the top 510 of the neck 507 to be pushed into the compound 504*a* which has been heated (e.g. to around 100° C.) to soften it for this purpose and to ensure contact is made around the entire circumference to create a complete seal. The annular gasket 504*b* which forms from compound 504*a* is shaped upon setting so as to provide the complete seal. The engagement between thread sections 511 and lugs 506 ensures the closure 500 is held securely to the container body 501 to maintain the seal prior to opening of the container, e.g. by an end user twisting the closure off the container body.

The gasket 504*b* has an inside radius (i.e. the radius of the innermost portion of the gasket) which is greater than a radius that is equal to an inside radius of the rim 510 less substantially 0.9 mm. The closure 500 has corresponding dimensions, namely the difference between an inside radius of the annular channel 503 at a channel depth of 0.2 mm and the inside radius of the rim 510 is less than substantially 0.9 mm, preferably less than substantially 0.8 mm for an even greater effect. This configuration gives rise to the surprising effect of reducing additive migration by a proportionately greater amount, for example, by between 30-90% depending on the contents of the container. For example, if the difference between the inside radius of the annular gasket 504*b* and the inside radius of the rim 510 is reduced from 1.2 mm to 0.9 mm (a 25% reduction)—an unexpectedly higher migration reduction of greater than 30% is achieved. A reduction to 0.8 mm (a 30% reduction) provides migration reduction greater than 30%. In cases where the difference between the inside radius of the annular gasket 504*b* and the inside radius of the rim 510 is zero, or the inside radius of the annular gasket 504*b* is larger than the inside radius of the rim 510, reductions of approximately 90-100% are achieved.

As a result of reduced additive migration, non-conventional materials or formulations of the gasket compound 504*a* can be used. For example, the monomeric and polymeric plasticiser ratio can be altered and the total amount of plasticiser in the compound 504*a* can be significantly increased without exceeding regulatory limits of product plasticiser contamination caused by additive migration. This may provide for a far greater degree of freedom to tailor plastisol formulations to specific needs and applications without exceeding regulatory limits.

Figure 1A:
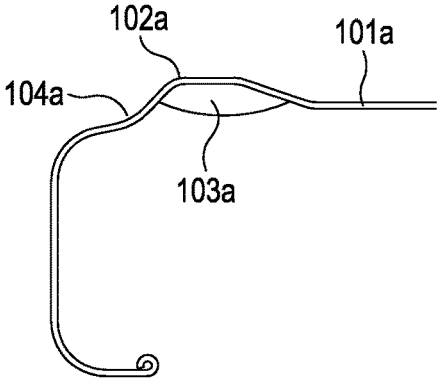
FIGS. 1*a* to 1*g* illustrate cross-sectional views of parts of exemplary known closures.
Figure 1B:
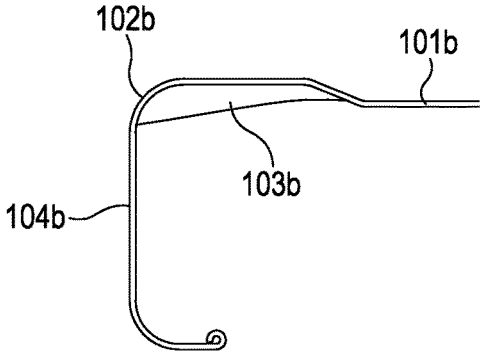
Figure 1C:
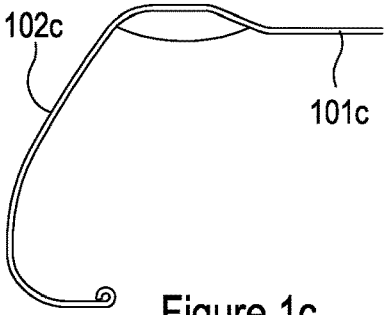
Figure 1D:
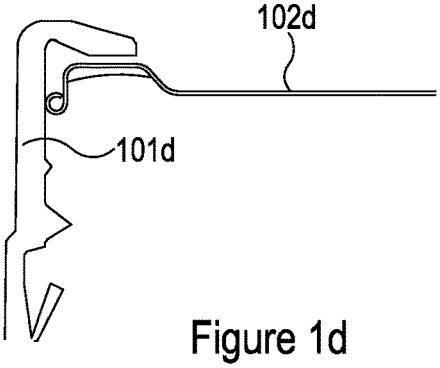
Figure 1E:
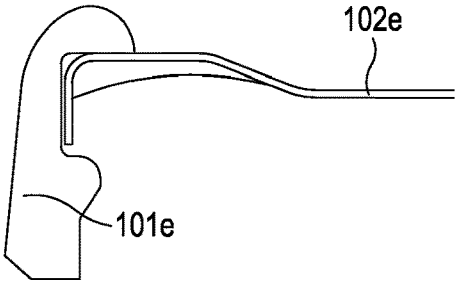
Figure 1F:
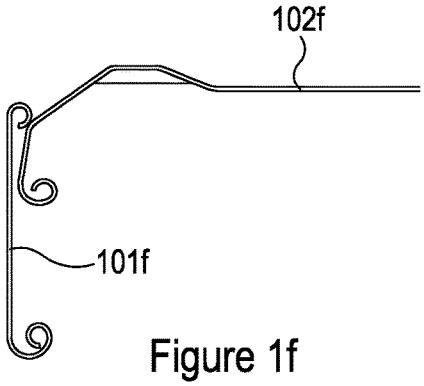
Figure 1G:
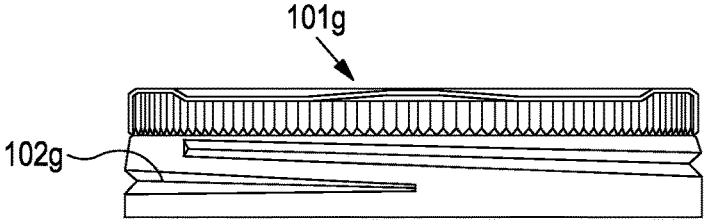

By way of example, additional additives can be included in compound 504*a* to reduce compound 504*a* viscosity and improve its rheological characteristics. For example, the total amount of plasticiser can be increased which alters the viscosity range of the compound from between 8000-9000 centipoise at 40° C. to between 4000-5000 centipoise. Additional consequences resulting from the reduced additive migration may include:

- Reduced line complexity because the time consuming technique of using conditioning units to warm up the compound 504*a* is no longer required to achieve the same level of viscosity.
- Increased line efficiency because time consuming compound change overs on the production line when switching between applications are required less often or not at all as the compound 504*a* can be formulated for a wider range of uses due to the increased freedom of additive choice (providing e.g. improved low migration characteristics and no need for temperature preconditioning).
- Reduced spoilage rate of closures and capped containers, to which additive migration and compound issues are major contributors. As each closure is inspected close to the end of the production line (e.g. using a vision system to look for defective compound coverage), any discards at this point on the production line have a significant effect on production efficiency and thus on profitability.
- Raw material cost reduction because expensive polyadipates can be replaced at least partially with cheaper phthalates where permitted by regulations without exceeding additive migration regulatory limits.
- Improved customisability and freedom to adapt to regulatory changes and/or ensure compliance with particularly strict regulatory requirements (e.g. by ensuring additive migration levels are significantly below a given limit).
- Reduction in total quantity of compound required. By way of example, a 63 mm diameter, regular stepped button closure (known as a 63 RSB closure), an example of which is shown in FIG. 1*a*, normally requires between 0.6-1.0 g of compound to line the annular channel. A closure and container according to the invention can reduce this to approximately 0.4 g of compound, thus providing a cost saving.
- Reduction in hardness of the compound material as a result of increased plasticiser content. By way of example, the compound may be made of a material of hardness as low as 50-60 Shore on the Shore A hardness scale instead of 70-80 Shore. A softer compound material forms a more effective seal between the closure and the top of the neck because it can more effectively deform around the top of the neck during capping. This is particularly important where the container is made of glass which has a high level of defects in the finish such as hairline cracks across the sealing surface, areas of higher flatness on the sealing surface, and/or a generally poor quality sealing surface finish. A softer material is also better at absorbing impacts and adjusting to changes in shape caused by ambient temperature changes thus providing a seal with greater impact and temperature resistance. A softer material also reduces the torque required to twist open or close the closure because there is a lower contact area between the top of the neck and the gasket, thereby permitting a reduction in slip agent additives while maintaining the same opening performance.

In the extreme case, additive migration can be reduced to substantially zero—as will be described with reference to FIGS. 6*a* and 6*b*—by providing a mechanical barrier to migration resulting from contact between the closure and the top of the neck of the container body.

Figure 6A:
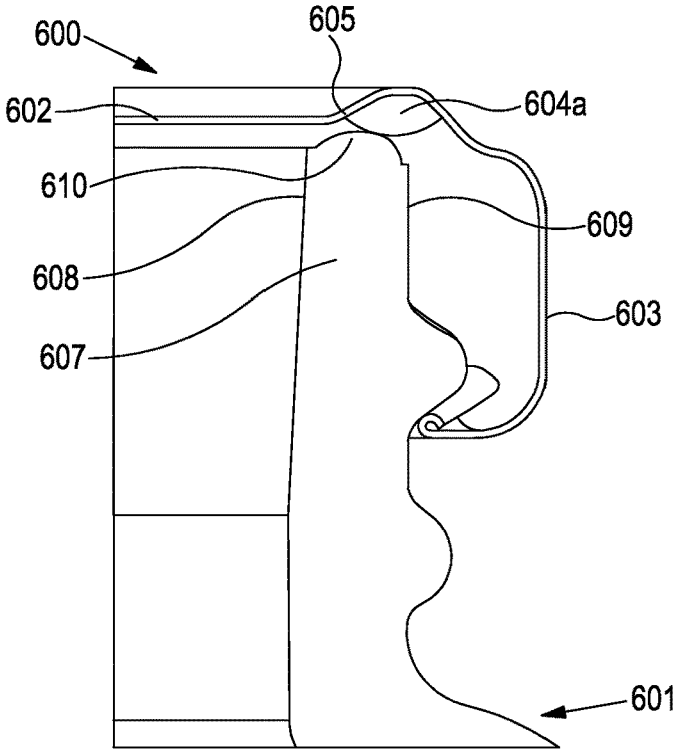
FIG. 6*a* shows a cross-sectional view of part of a closure and container body neck of a container according to an embodiment before capping.

FIG. 6*a* shows a cross-sectional view of a portion of a closure 600 and a container body 601, where the closure has been placed on the container body but has not been twisted on. The container body may be the same container as that shown in FIGS. 5*a*-5*b*. The closure 600 is similar to the closure 500 shown in FIGS. 5*a*-5*b*. However the inside radius 605 of the gasket compound 604*a* is greater than the inside radius of the rim 610 such that, after undergoing capping (as shown in FIG. 6*b*), contact is made between the closure 600 and the rim 610. This contact acts as a mechanical barrier which limits exposure of a large portion of the gasket 604*b* to the volume enclosed by the container body 601 after capping. Given that the closure 500 and glass mating surfaces of the rim 610 are typically not flat or perfectly concentric there will normally be a small gap having a radial dimension of less than 0.1 mm around the majority of the circumference of the closure. Despite this gap, additive migration in this embodiment is effectively zero as a result of the mechanical barrier which reduces the width of any exposed portions to less than 0.1 mm.

It is envisaged that any contact between the closure 600 and the rim 610 will normally be prevented during the high-speed capping process itself (e.g. by making compound 604*a* sufficiently stiff) to ensure the closure 600 and rim 610 do not damage or scratch each other by way of relative movement during capping. Instead, contact may be created in a post-capping step using an axial load and/or change in temperature to reduce the stiffness of the gasket 604*b*. The necessary axial load may be generated by stacking multiple containers during storage. There is negligible risk of scratching caused by relative movement during such a post-capping step. FIGS. 6*a* and 6*b* also show the centre panel 602 and the side wall 603 of the closure 600, as well as the inner surface 608 and outer surface 609 of the neck 607 of the container body 601.

Figure 6B:
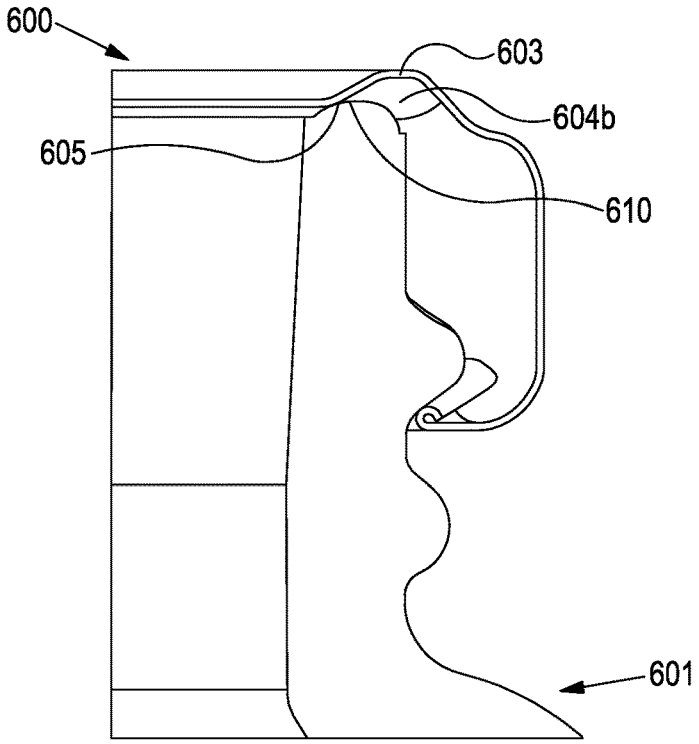
FIG. 6*b* shows a cross-sectional view of the closure and container body neck of FIG. 6*a* after capping.

The embodiment of FIGS. 6*a* and 6*b* provides the same advantages as those set out above in respect of FIGS. 5*a*-5*d*, as well as the following further benefits:

- Cut through of the compound is prevented. Cut through is a defect that can occur during stacking when a high load causes the finish (e.g. a thread) to creep through the compound which is possible because it has elastomeric characteristics. This causes the compound to split apart into an inner and outer ring which compromises seal integrity. Cut through can also be the result of the compound being undercured during heating and may in some cases occur even before stacking.
- Opening torque is further reduced as the total contact area between the compound (which has a relatively high coefficient of friction) and the top of the neck is less than that of the embodiment of FIGS. 5*a*-5*d*. Further, as the load is partly taken by the contact between the container and the closure, there is a lower load on the compound, hence a lower frictional torque.
- Entirely new materials can be used in the compound, or instead of the compound, because there is no risk of compound cut through or additive migration. For example, very soft materials can be used which have poor migration resistance but give excellent sealing performance. An example of an alternative material which may be used is soft thermoplastic. Soft thermoplastic is not normally considered for this type of application.

Figure 7:
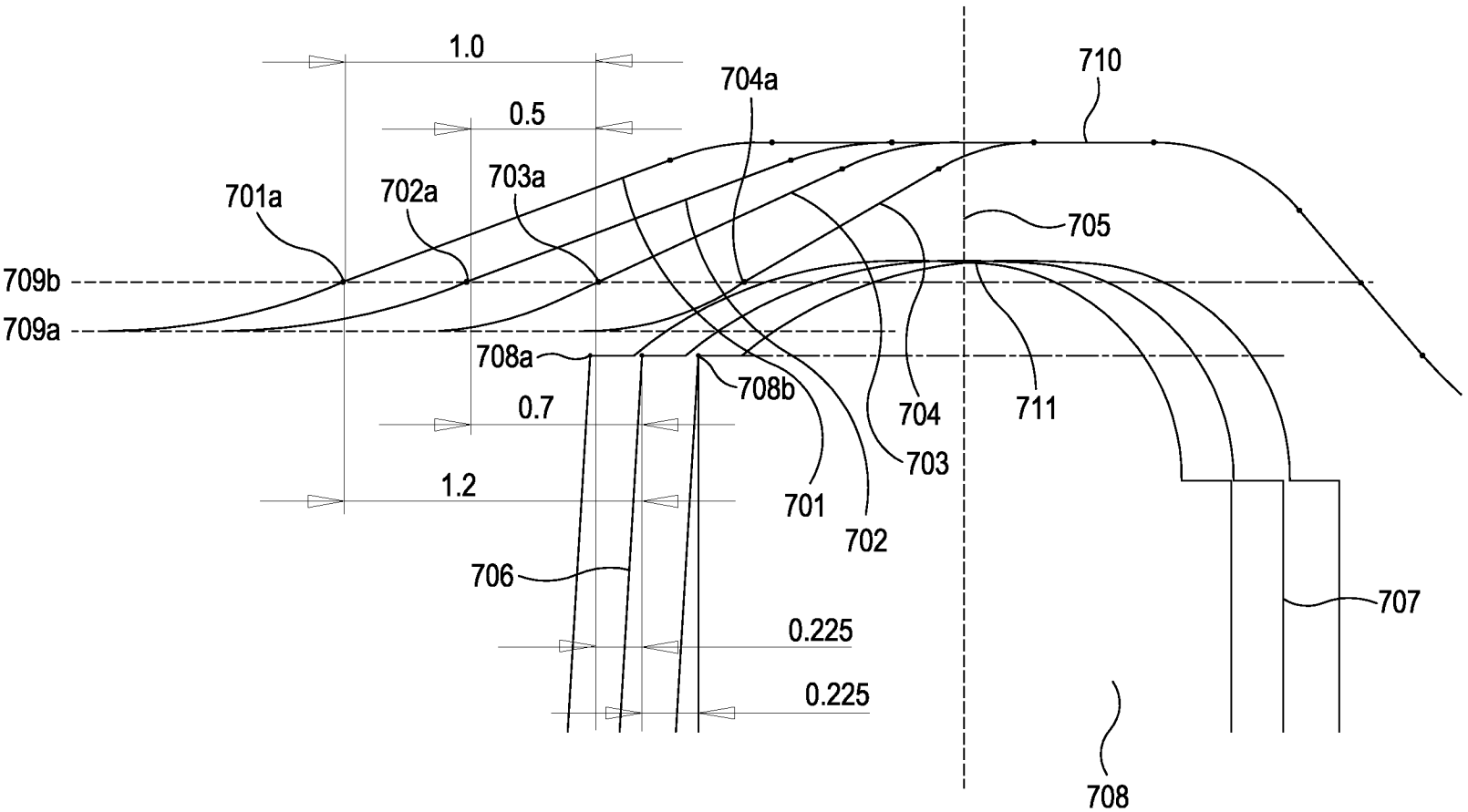
FIG. 7 schematically shows a cross-sectional view of part of four closures and a container body neck.

FIG. 7 shows schematically the dimensions of a portion of four closures 701, 702, 703, 704 of the type shown in FIGS.

5*a* to 6*b*, and a portion of a neck 708 of a container body. A manufacturing tolerance of the neck 708 of +/−0.225 mm (measured at the top of the inner surface of the neck) is shown by outlines 708*a* and 708*b*. Each closure has an annular channel 710 of a different width. In particular, the inside radius of the annular channel is different for each of the four closures whereas the outside radius of the annular channel is the same. When the gasket is formed in the annular channel 710, its inside radius will vary depending on the width of the annular channel. The inside radius of the gasket formed in each of the four closures is illustrated by reference numerals 701*a*, 702*a*, 703*a*, 704*a*. The annular channel width may be measured with respect to the centre line 705 which is equidistant from tops of inner surface 706 and outer surface 707 of the neck 708. Annular channels are filleted to avoid sharp edges. The annular channel is normally filled with the gasket compound leaving an approximately 0.2 mm height clearance between the height 709*a* at the edge of the channel and the height 709*b* of the surface of the gasket at its inside radius. However other height clearances may also be used.

The first closure 701 in FIG. 7 has a gasket with an inside radius 701*a* which is 1.2 mm smaller than the inside radius of the rim 706 to provide a clearance of 1.2 mm. It is conventional in known closures such as in the closure of FIGS. 2*a*-2*b* to provide at least a 1.2 mm clearance to compensate for the typical manufacturing tolerances in the neck 708 as described above. A main cause of manufacturing tolerances is glass mould wear which causes an increase in thickness of the neck as the mould wears over its lifetime). In the case where the tolerance of the neck 708 is at its lower limit (i.e. the radius of the inner surface is −0.225 mm from its target radius), the clearance is approximately 1.0 mm (i.e. 1.2 mm less 0.225 mm). There may also be some misalignment of the closure when it is capped onto the container body, and of the gasket compound as it flows into the annular channel (e.g. under gravity or during spinning), which is compensated for by the conventional clearance of 1.2 mm. For the first closure 701, when the gasket compound is present in the channel as described above, the radial distance from an innermost point to an outermost point along the surface of the gasket compound, known as the nominal compound channel width, is approximately 4.3 mm.

In contrast to the first closure 701 in FIG. 7, the second, third and fourth closures 702, 703, and 704 have respectively reduced channel widths and provide an additive migration reduction of between 30-90% compared to the first closure 701. The respective gaskets in the second, third and fourth closures have respective inside radii 702*a*, 703*a*, 704*a* which are 0.9 mm or less away from the inside radius of the rim 711. The difference between the inside radius 702*a* of the gasket in the second closure 702 and the inside radius of the rim 711 is 0.7 mm. At the respective upper and lower limits of manufacturing tolerance (i.e. where the radius of inner surface 706 is 0.225 mm greater or smaller due to glass mould wear), this is respectively increased or reduced to approximately 0.9 mm or 0.5 mm. At 0.9 mm, additive migration reduction becomes apparent. For the second, third and fourth closures 702, 703, 704, the nominal compound channel widths are approximately 3.8 mm, 3.2 mm, and 2.6 mm respectively. For the fourth closure 704, the inside radius 704*a* of the gasket is greater than the inside radius of the rim 711 thus providing a mechanical barrier as described above with reference to FIGS. 6*a* and 6*b*.

Figure 8:
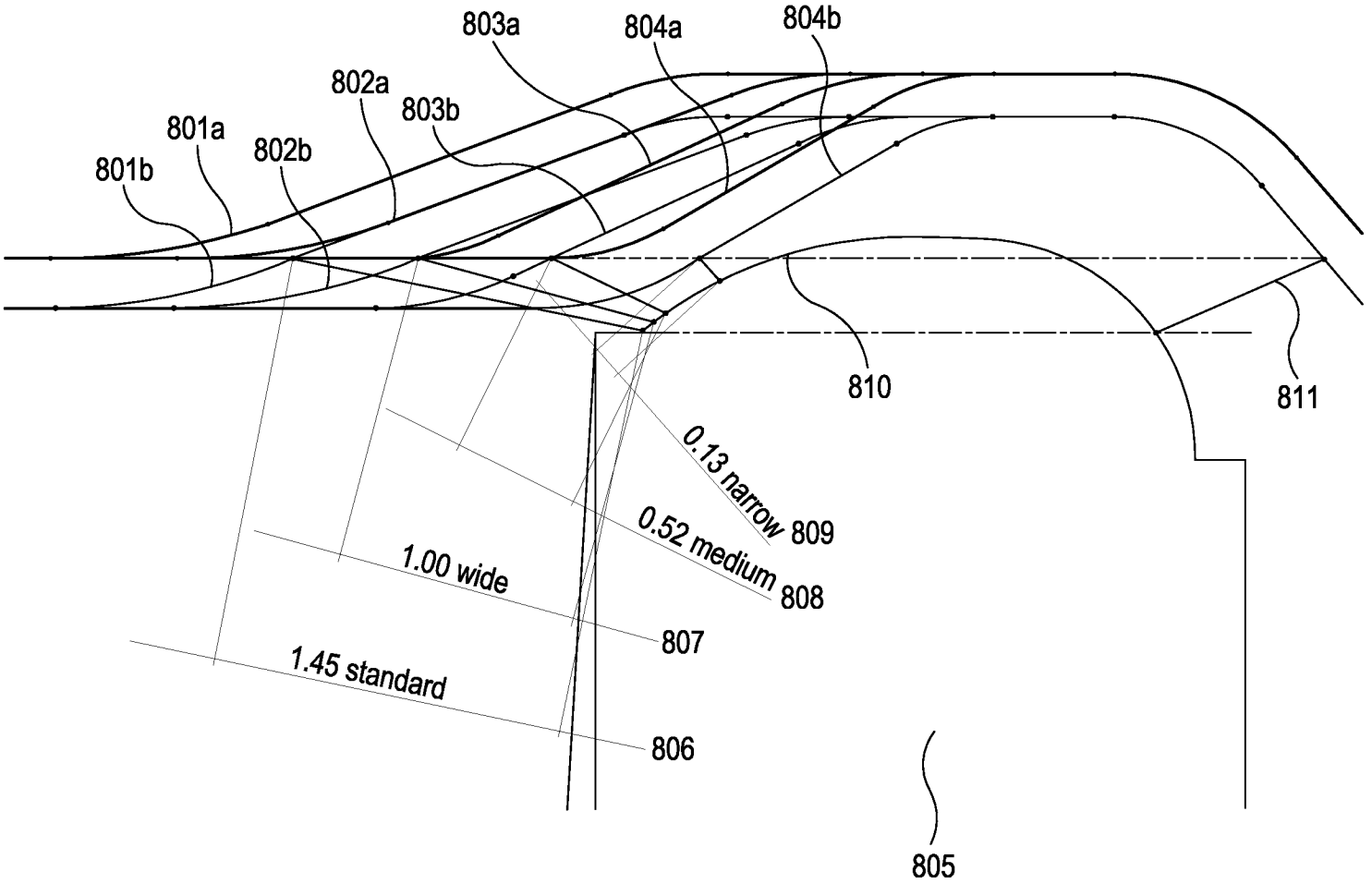
FIG. 8 schematically shows a cross-sectional view of part of four closures and a container body neck.

FIG. 8 schematically shows the dimensions of a portion of four closures before capping (801*a*, 802*a*, 803*a*, 804*a*) and after capping (801*b*, 802*b*, 803*b*, 804*b*) onto a neck 805 of a container body. The closures have annular channels with different channel widths and correspond approximately to the closure geometries described in connection with the first, second, third and fourth closures 701, 702, 703, 704 in FIG. 7. In each case, once capped, the compound disposed in the annular channel has formed a gasket to provide a seal against the rim 810. The width of the portion of the gasket which is exposed to the volume enclosed in the container for each of the closures 801*b*, 802*b*, 803*b*, 804*b* is shown by numerals 806, 807, 808 and 809 respectively. The width of the exposed portion is approximately the shortest distance between the inside radius of the annular gasket and where the gaskets contacts the rounded part of rim 810. The width of the portion of the gasket which is exposed to the exterior of the container is shown by numeral 811 and is approximately the same for each of the first, second, third and fourth closures.

In the examples given in FIG. 8, the width or radial dimension of the exposed portion of the gasket for each of the first, second, third and fourth closures 801*b*, 802*b*, 803*b*, 804*b* is 1.45 mm, 1.00 mm, 0.52 mm, and 0.13 mm respectively. In the case where a closure provides a complete mechanical barrier such that no portion of the gasket is exposed to the volume inside the container (not shown in FIG. 8), the width of the exposed portion is effectively zero. Where the width of the exposed portion is 1.45 mm, there is no significant reduction in additive migration compared to known closures such as those of FIGS. 2*a*-2*b*. Where the width of the exposed portion is 1.2 mm or less, the above described migration reductions of 30-90% are present. Where the width of the exposed portions is 1.0 mm or less, the migration reductions are significant compared to an exposed portion width of 1.45 mm. In order to measure the width of an exposed portion in a capped container, the closure can be removed from the container body and the distance from the innermost radius of the gasket to the point where the impression of the top of the neck starts in the gasket (i.e. resulting from the slight compression) can be measured.

For additive migration testing of the first, third, and fourth closures 801*b*, 803*b*, and 804*b* using a standard version of a low migration compound such as N61 low migration ESBO-NI compound, overall migration (i.e. the reduction in weight of the cap after undergoing migration testing) for the first closure 801*b* is 14.92 mg. In contrast, the third and fourth closures 803*b* and 804*b* have overall migrations of 6.64 mg and 1.60 mg respectively which correspond to migration reductions of 56% and 89% compared to the first closure 801*b*. The second closure 802*b* has a migration reduction of approximately 30% over closure 801*b*. Further additive migration testing demonstrated similar reductions in migration for the first, second, third and fourth closures 801*b*, 802*b*, 803*b*, 804*b*. For example, in tests using the same N61 gasket compound described and using olive oil as a container content simulant where the filled container was heated to 100° C. for 1 hour and to 60° C. for 10 days, the overall migration in mg per closure for the four closures 801*b*, 802*b*, 803*b*, 804*b* were found to be 19.3, 13.6, 9.5 and 7.4 respectively. Relative to the first closure 801*b*, these correspond to migration reductions of 29.5%, 50.8%, and 61.7% respectively. In tests where the gasket compound was a known, standard S24 compound similar to the N61 compound described above, overall migration in mg per closure for the four closures 801*b*, 802*b*, 803*b*, 804*b* was found to be 22.0, 15.0, 11.2, and 8.3 respectively. Relative to the first closure 801*b*, these correspond to migration reductions of 31.8%, 49.1% and 62.3% respectively.

Furthermore, decreasing the viscosity of the gasket compound surprisingly does not substantially increase additive migration in the third and fourth closures 803*b* and 804*b* as might be expected. In particular, using a lower viscosity, modified formulation of the N61 low migration ESBO-NI compound which contains more monomeric plasticisers (referred to herein as diluted N61 which contains 32% plasticiser by mass in contrast to the standard N61 low migration ESBO-NI compound which contains only 30% plasticiser by mass—the difference being due to an increase in monomeric plasticisers which have a greater effect on reducing viscosity), overall additive migration for the first closure 801*b* increases to 20.53 mg. For the third and fourth closures 803*b* and 804*b*, overall additive migration only increases to 9.56 mg and 2.39 mg which still corresponds to migration reductions of 53.4% and 88.3% respectively. Migration reductions of up to approximately 90% are thus achieved despite the gasket compound having decreased viscosity. The decreased viscosity makes the gasket compound easier to apply to the annular channel and makes it easier to guarantee a complete seal around the entire circumference of the top of the neck.

Surprisingly, the percentage reduction in additive migration is proportional to the exposed portion width irrespective of the viscosity of the compound used to form the gasket. In particular, a reduction in exposed portion width from 1.45 mm to 1 mm (a 31% reduction) results in approximately 30% migration reduction. A reduction in exposed portion width from 1.45 mm to 0.52 mm (a 64% reduction) results in approximately 56% migration reduction. A reduction in exposed portion with from 1.45 mm to 0.13 mm (a 91% reduction) results in approximately 89% migration reduction. These percentage reductions hold true for gaskets made of standard N61 low migration ESBO-NI compound as well as for gaskets made of the diluted N61 compound described above.

A further advantage of the narrower channel widths is that the total weight of gasket required to fill the channel is reduced, thereby reducing the cost of the gasket compound used per closure. For example, for the fourth closure 804*b*, a total gasket compound weight reduction of up between 32-38% is achieved depending on the gasket compound used (for example the N61 or S24 compounds described above). Accordingly, the closures of the present disclosure allow closures to be manufactured more cheaply.

Figure 2A:
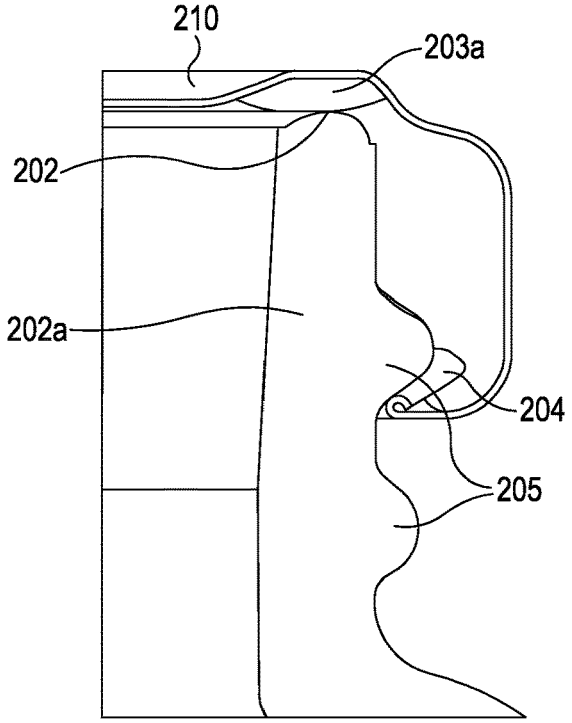
FIGS. 2*a* and 2*b* show a cross-sectional view of part of a known closure and container body neck before and after capping.
Figure 2B:
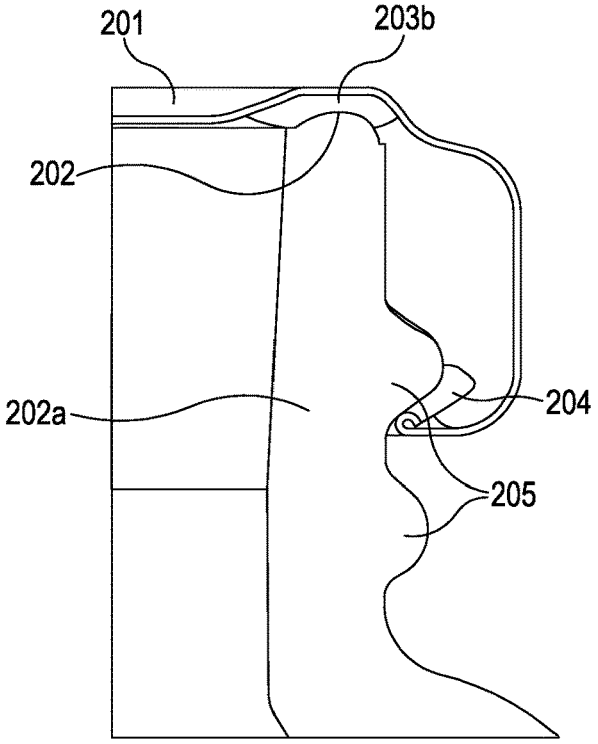
Figure 3:
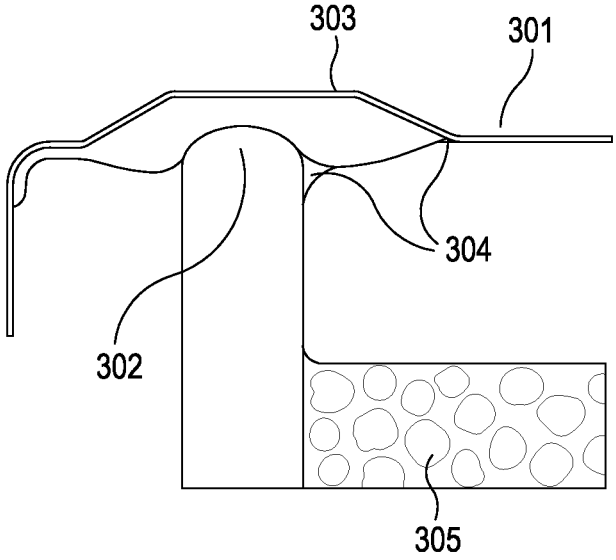
FIG. 3 shows a cross-sectional view of part of a known closure and container body.
Figure 4:
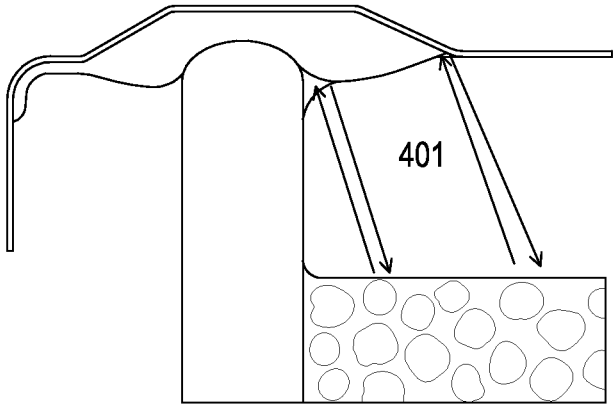
FIG. 4 shows a cross-sectional view of part of a known closure and container body.
Figure 9:
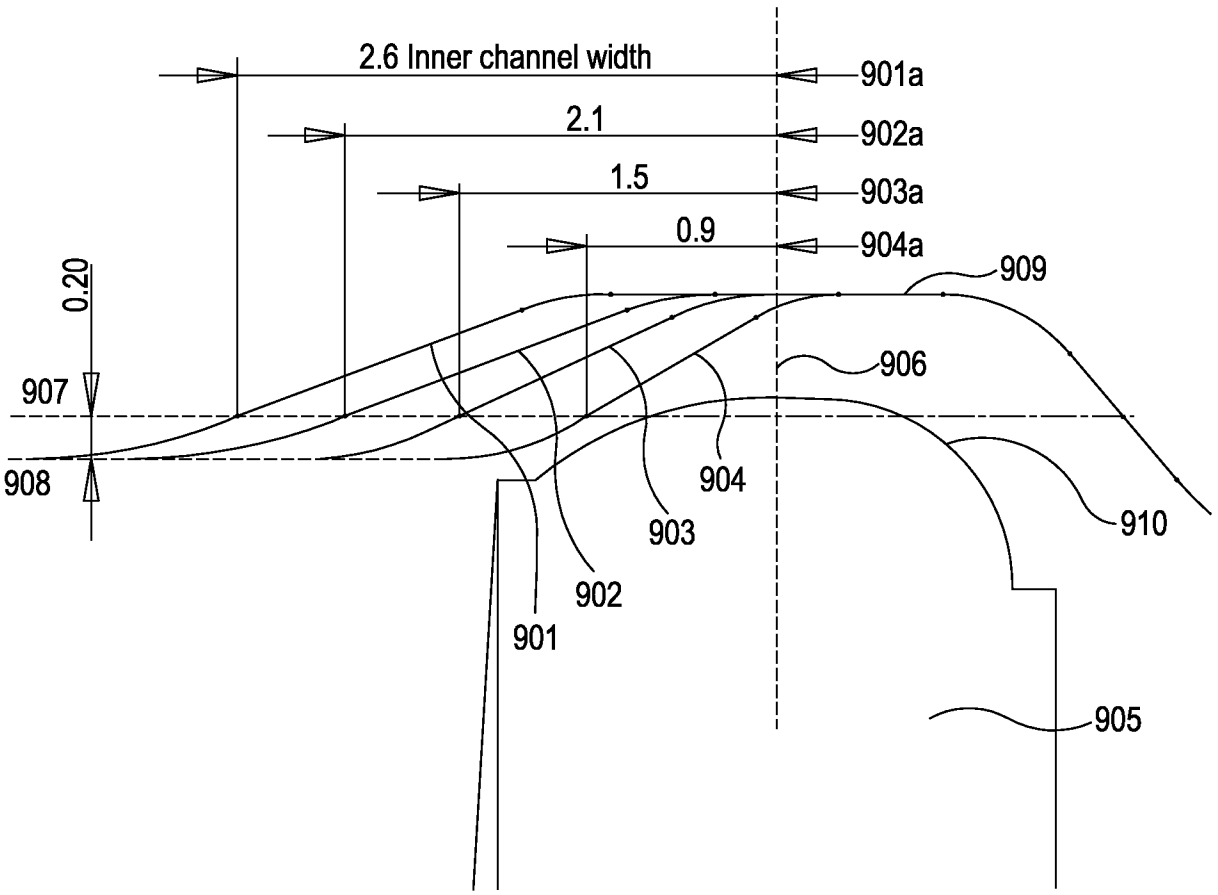
FIG. 9 schematically shows a cross-sectional view of part of four closures and a container body neck.

FIG. 9 schematically shows the dimensions of a portion of four closures 901, 902, 903, 904 and the rim 910 of a neck 905 of a container body after capping. The four closures 901, 902, 903, 904 correspond approximately to closures 801*b*, 802*b*, 803*b*, 804*b* in FIG. 8. Reference numeral 906 indicates the centre line which is equidistant from the inner surface and outer surface of the neck 905. An annular channel 909 is formed in each of the four closures. As described above in connection with FIG. 7, the outside radius of the annular channel is the same for each of the four closures and only the inside radius of the annular channel varies between the four closures. The inside radius of the gasket thus also varies accordingly. The difference between the inside radius of the gasket the centre line 906 is said to be the "inner channel width". In FIG. 9, the inner channel widths 901*a*, 902*a*, 903*a*, 904*a* for each of the four closures 901, 902, 903, and 904 are shown corresponding respectively to inner channel widths of 2.6 mm, 2.1 mm, 1.5 mm and 0.9 mm respectively. As described above in connection with FIG. 7, it is envisaged that there is approximately a 0.2 mm height clearance between height 907 of the surface of the gasket at its inside radius, and the height 908 at the edge of the annular channel. Where the inner channel width is 2.6 mm, migration reduction compared to the known closure of FIGS. 2*a*-*b* is not present. In contrast, where the inner channel width is 2.3 mm or less, the above described migration reductions of 30-90% are present. For an inner channel width of 2.1 mm or less, additive migration reduction of greater than 30% is achieved. For an inner channel width of 1.5 mm (i.e. a reduction of only 0.9 mm), a migration reduction of approximately 56% is achieved. For an inner channel width of 0.9 mm, a migration reduction of approximately 89% is achieved.

By reducing the inner channel width compared to known closures such as those in FIGS. 2*a*-2*b*, the total amount of compound required in the annular channel is also reduced, thus providing a cost saving on gasket compound materials. In particular, when the third closure 703, 803 and 903 of FIGS. 7, 8 and 9, is capped onto a 63 mm diameter container body, approximately 0.4 g of compound is required to form the gasket (corresponding to approximately 6.4 mg/mm of arc length of the gasket (i.e. less than 8 mg/mm) which is approximately constant around the circumference of the gasket and, given that the profile dimensions of the annular channel is similar irrespective of the diameter of the closure, is applicable to closures of diameters including 30, 33, 38, 43, 48, 53, 58, 63, 66, 70, 77, 82, 89, 100, 110 mm). In contrast, the first closure 701, 801 and 901 in FIGS. 7, 8 and 9 requires approximately 0.6 g of compound (corresponding to approximately 9.5 mg/mm). A reduction of 0.2 g per closure is thus achieved. Even higher reductions in compound usage are achieved by reducing the inner channel width further.

As described above, conventional wisdom is to provide a clearance of at least 1.2 mm between the inside radius of the gasket and the inside radius of the rim to compensate for manufacturing tolerances. One reason for this is that contact between the closure and the container body may lead to failure of the seal because forces and loads are no longer absorbed by the gasket but are instead applied directly to the container body through the closure. Example forces and loads which need to be absorbed include those experienced during capping and those experienced during storage (e.g. containers stacked onto pallets which are then stacked up to three or more pallets high). In the example of a metal (e.g. steel) closure and a glass jar, direct contact between metal and glass may lead to high localised stress and damage to any coatings applied to the metal closure. Coating damage may lead to corrosion of the metal which may contaminate the product stored in the container.

However, by controlling the manufacturing tolerance of the lugs on the closures to +/−0.15 mm, and by designing new tooling to create the annular channel geometry in the closure to produce the above described dimensions, and by more precisely controlling the lining process where gasket compound is disposed in the annular channel, conventional clearances of 1.2 mm or more can be reduced to 0.9 mm or less, and contact can be made between the metal closure and the glass jar in a more controlled manner without increasing the risk of damage. This provides a container which achieves a dramatic additive migration reduction of between 30-90%, whilst simultaneously maintaining seal quality, coating integrity, and stack load performance. In order to form the above described closures, a method is provided comprising flowing heated plastisol into the annular channel of the closure and allowing it to settle and cool under gravity.

Figure 10:
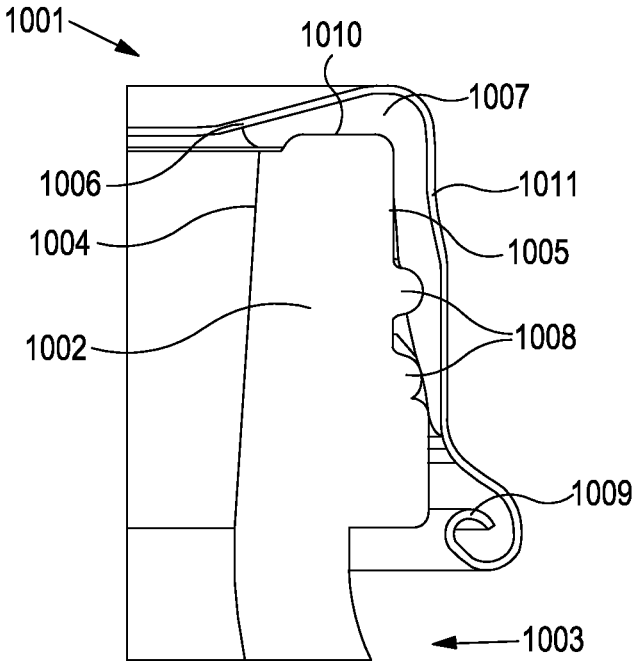
FIG. 10 shows a cross-sectional view of part of a known push-on-twist-off closure and container body neck after capping.

FIG. 10 shows a schematic cross-sectional view of a portion of a known push-on-twist-off closure 1001 and neck 1002 of container body 1003. Push-on-twist-off type closures typically have a diameter of 51 mm or 58 mm. Closure 1001 is manufactured with a PVC based compound for forming a gasket 1007 moulded onto the inside of sidewall 1011 of the closure 1001; gasket 1007 includes a location 1006 that defines the inside radius of gasket 1007. This provides additional sidewall impact resistance compared to twist closures. A thread 1008 is provided on the outer surface 1005 of the neck 1002 of the container body 1003. The term thread is to be understood to include continuous thread or overlapping thread sections. The gasket 1007 extends over and engages with the thread 1008. The mechanical characteristics of the gasket 1007 permit the closure to be pushed onto the container body 1003 on production lines without needing to twist the closure on during capping. When the gasket 1007 is pushed onto the container body, it deforms slightly to match the shape of the thread 1008. The friction between the thread 1008 and the gasket 1007 keeps the closure 1001 in position and maintains a seal. Twisting the closure 1001 causes the thread 1008 to rotate through the shape which was formed in the gasket 1007 providing a means to overcome the friction and open the container. The gasket 1007 is considered to be the entire piece of plastisol compound, including that which extends over the thread 1008 and not just the part of the plastisol which provides sealing functionality. The neck 1002 has an inner surface 1004 and an outer surface 1005, and a rim 1010 defined there between. The gasket 1007 is compressed between the closure 1001 and the rim 1010 to provide a seal around the circumference of the circular opening defined by the rim 1010. The sidewall 1011 of the closure 1001 extends downwards to cover the thread 1008 and provides an outer surface which can be gripped by an end user of the container. The sidewall 1011 is curved inwards at its end 1009 to ensure an end user is not exposed to sharp edges. The width of the portion which is exposed to the inside of the container (measured in the same way as described with respect to FIG. 8) is approximately 0.97 mm. The closure 1001 of FIG. 10 does not have reduced additive migration compared to known closures.

Figure 11:
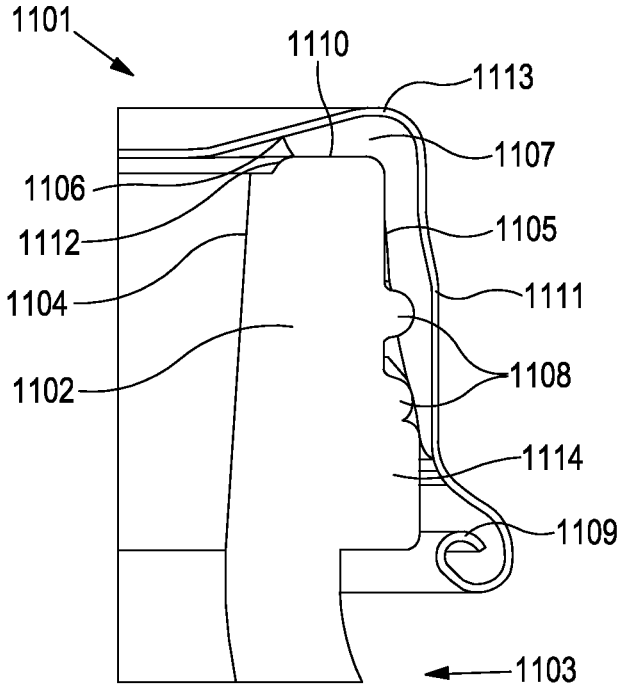
FIG. 11 shows a cross-sectional view of part of a push-on-twist-off closure and container body neck of a container according to an embodiment after capping.

FIG. 11 shows a schematic cross-sectional view of a portion of a push-on-twist-off type closure 1101 and neck 1102 of a container body 1103. The neck 1102 has an inner surface 1304 and an outer surface 1105, and a rim 1110 defined there between. The rim 1110 is generally flat but has a rounded step 1112 thereon. The lip where the outer surface 1105 meets the rim 1110 is rounded. An annular gasket 1107 is disposed partially in an annular channel 1113 of the closure 1101 and is compressed between the closure 1101 and the rim 1110 to provide a seal around the circumference of the rim 1110; gasket 1107 includes a location 1106 that defines an inside radius of gasket 1107. As with the gasket of FIG. 10, the gasket 1107 in FIG. 11 extends over and engages with the thread 1108 on the outside of the neck 1102, and deforms to match the shape of the thread 1108 to provide the push-on-twist-off functionality described above. The sidewall 1111 and curved edge 1109 are the same as those in FIG. 10. The neck 1102 has a portion of greater thickness 1114 below the thread 1108. The width of the portion of gasket exposed to the inside of the container is only 0.44 mm which provides an additive migration reduction of approximately 50% compared to the closure of FIG. 10. In order to achieve an exposed portion of 0.44 mm, the radial position of the start of the moulded gasket in the annular channel 1113 is approximately 1.0 mm more than the radial position of the start of the inner channel in the closure of FIG. 10.

Figure 12:
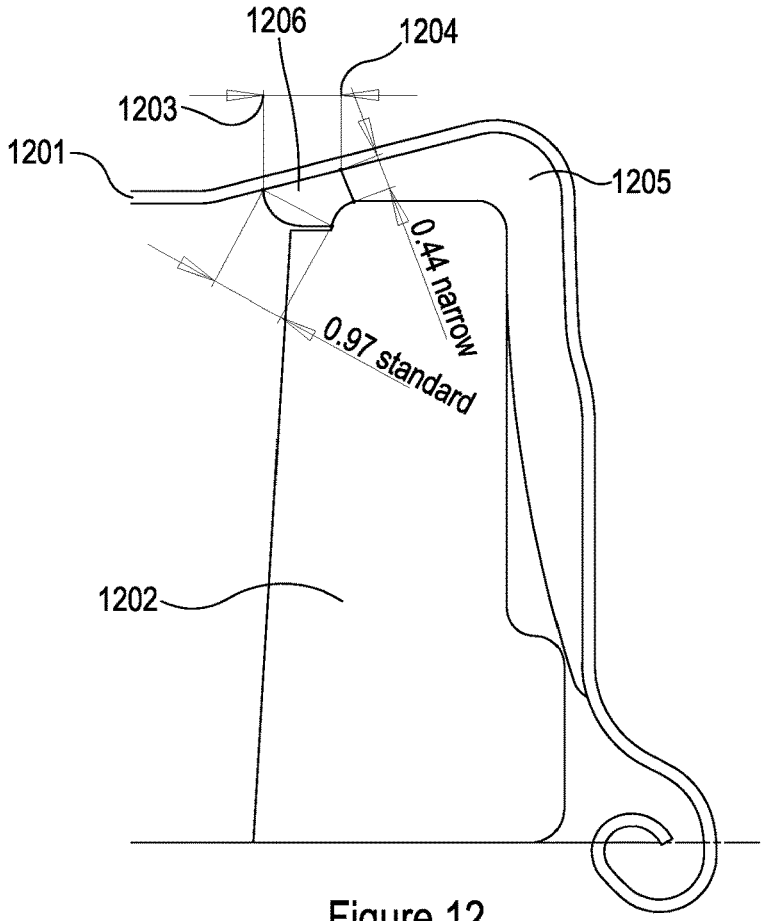
FIG. 12 schematically shows a cross-sectional view of part of two push-on-twist-off closures and a container body neck.

FIG. 12 schematically shows the dimensions of a portion of closure 1201, which is a closure of the type shown in FIGS. 10 and 11, capped onto a neck 1202. Reference numerals 1203 and 1204 correspond to two different inside radii of different gaskets 1205, 1206. In particular, reference numeral 1203 corresponds to the inside radius of a gasket 1206 found in the closure of FIG. 10, and reference numeral 1204 corresponds to the inside radius of a gasket 1205 found in the closure of FIG. 11. The difference between the two inside radii is 1.0 mm. This reduces the width of the exposed portion of the gasket from 0.97 mm to 0.44 mm. The corresponding reduction in additive migration is over 50%. In other words, an increase of just 1.0 mm to the inside radius of the gasket reduces the width of exposed portion of the gasket from around 1.0 mm to less than 0.5 mm and reduces additive migration by over 30% and preferably around 50%. The thread is not shown in FIG. 12.

Figure 13:
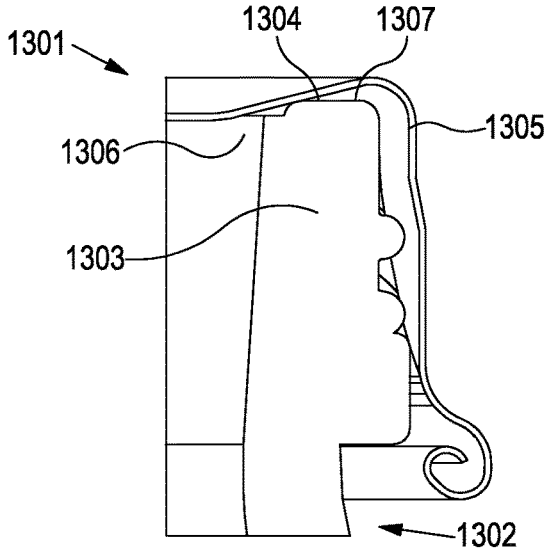
FIG. 13 shows a cross-sectional view of part of a push-on-twist-off closure and container body neck of a container according to an embodiment after capping.

FIG. 13 shows a schematic cross-sectional view of a portion of a push-on-twist-off closure 1301 and a neck 1303 of a container body 1302 which is similar to the embodiment of FIG. 11. It differs from the embodiment of FIG. 11 in that the inside radius 1304 of the annular gasket 1305 is greater than the inside radius 1306 of the rim 1307 to such an extent that, when the container is closed by pushing the push-on-twist-off closure 1301 onto the container body 1302, the closure 1301 contacts the rim 1307 to provide a mechanical barrier in the same way as the embodiment of FIGS. 6*a* and 6*b*. This effectively reduces migration to zero as it limits exposure of the annular gasket 1305 to a volume enclosed by the container by reducing any gap to less than 0.1 mm. As in the embodiment of FIGS. 6*a* and 6*b*, contact may be generated by one or more of the following factors: axial load during capping, flow of gasket compound during processing, internal vacuum after capping, and/or axial load during stacking.

As with the other embodiments described herein, conventional wisdom has been to avoid contact entirely as it may lead to failure of the seal because forces and loads are no longer absorbed by the gasket but are instead applied directly to the container body through the closure. However, by controlling manufacturing tolerances as described above, contact between the metal of the closure and the glass jar can be achieved in a more precise and controlled manner without increasing the risk of damage.

It will be appreciated by the person skilled in the art that various modifications may be made to the above described embodiment without departing from the scope of the present invention. For example, whilst the closures of FIGS. 2-9 are regular stepped button twist-on-twist-off closures, and the closures of FIGS. 10-13 are push-on-twist-off closures, it is envisaged that the above described 30-90% and total reductions in additive migration may be achieved when the invention is applied to other types of closures as well including other twist-on closures such as those of the type illustrated in FIGS. 1*a* to 1*g*. These closure types include vacuum closures generally as well as closure types known as Twist, Stepped, Eco, Ideal, Preson, Orbit and CT closures. Whilst in the closure types shown in FIGS. 1*a*, 1*b*, and 1*c* the depending sidewall and centre panel are integral, this is not always the case as can be seen in the closure types of FIGS. 1*d*, 1*e*, and 1*f*. For example, in the closure types of FIGS. 1*d*, 1*e* and 1*f*, the depending sidewall is not integral with the centre panel but is a distinct, separate component to the centre panel and may also be made of a different material where required. Further, in these closures, the depending sidewall may be rotatable relative to the centre panel which, due to engagement with the finishing on the rim, provides an upwards force to break the vacuum without having to overcome the rotational friction of the gasket against the inner rim. The diameter of the closures may also be any of the international standard closure diameters such as 30, 33, 38, 43, 48, 53, 58, 63, 66, 70, 77, 82, 89, 100, 110 mm.

In a further example, It is also envisaged that the annular gasket in the twist-on-twist-off closures of FIGS. 2-9 may comprise a compression moulded thermoplastic elastomer (TPE) based material (rather than a flowed-in PVC based material) of a similar type to that of the closures of FIGS. 10-13. TPE materials often have a reduced additive migration compared to PVC based materials. A method or providing a closure having compression moulded annular gasket such as those described above may comprise providing a heated thermoplastic elastomer material on the closure and applying a cooled punch to rapidly shape, cool and thus solidify the material into a desired gasket shape.

Additionally, the materials used in TPE and other PVC-free gasket compounds to reduce friction also typically migrate to some extent so the above described embodiments may also be used to reduce migration of these friction reducing compounds.

The invention claimed is:

1. A container comprising:

a container body having a neck, the neck having inner and outer surfaces and a rim extending between tops of the inner and outer surfaces, and the rim defining a circular opening; and a closure having a centre panel, the closure defining an annular channel, and an annular gasket disposed in the annular channel, the annular channel receiving said rim of said neck such that the annular gasket forms a seal between said rim and said closure, wherein, when the container body is closed by the closure, the difference between an inside radius of the annular channel at a channel depth of 0.2 mm and an inside radius of said rim is less than 0.7±0.225 mm; and wherein when the container body is closed by the closure, a portion of the annular gasket is exposed to a volume enclosed by the container body, and a radial dimension of the exposed portion is less than 1.0±0.225 mm.

2. A container according to claim 1, wherein an inside radius of the annular gasket is greater than a radius that is equal to said inside radius of said rim less 0.7±0.225 mm.

3. A container according to claim 1, comprising a thread on the outer surface of the neck, wherein the closure comprises a sidewall provided with lugs for engaging with said thread, and wherein annular channel is defined in the closure between the centre panel and the sidewall.

4. A container according to claim 1, wherein said rim comprises a substantially continuously curved region connected to one or both of the inner and outer surfaces by a lip or lips.

5. A container according to claim 1, wherein, the inside radius of the annular gasket is greater than a radius that is equal to the inside radius of said rim less 0.6±0.225 mm.

6. A container according to claim 1, wherein an inside radius of the annular channel at a channel depth of 0.2 mm is greater than a radius that is equal to an inside radius of said rim less 0.6±0.225 mm.

7. A container according to claim 1, wherein the inside radius of the annular gasket is greater than the inside radius of the rim.

8. A container according to claim 1, wherein, when the container body is closed by the closure, a first portion of the closure contacts said rim to limit exposure of the annular gasket to a volume enclosed by the container body, and wherein a portion of the annular gasket is exposed to the volume enclosed by the container body, and a radial dimension of the exposed portion is less than 0.1 mm.

9. A container according to claim 1, wherein, when the container body is closed by the closure, the difference between the inside radius of the annular gasket and a radius at the centre of the rim is less than 2.1±0.225 mm.

10. A container according to claim 1, wherein the mass of the annular gasket per mm of arc length of the annular gasket is less than 8 mg/mm or less than 6.4 mg/mm.

11. A container according to claim 3 wherein a lower end of the sidewall is curled inwardly and said lugs are formed by varying the radius of curvature of the curl around the circumference of the closure, wherein said annular gasket is formed of plastisol, and wherein said closure is a vacuum closure.

12. A container according to claim 1 wherein said annular gasket comprises a compression moulded thermoplastic elastomer.

13. A container comprising:

a container body having a neck, the neck having inner and outer surfaces and a rim extending between tops of the inner and outer surfaces, and the rim defining a circular opening, and a thread on the outer surface of the neck; and a closure having a centre panel and a depending sidewall, the closure defining an annular channel between the centre panel and the sidewall, and an annular gasket disposed partially in the annular channel and partially on the inside of the sidewall for engaging with said thread, the annular channel receiving said rim of said neck such that the annular gasket forms a seal between said rim and said closure, wherein, when the container body is closed by the closure, an inside radius of the annular gasket is greater than an inside radius of said rim; and wherein the annular gasket extends over and engages with a thread on the outer surface of the neck thereby deforming to match the shape of the thread.

14. A container according to claim 13, wherein said rim comprises a substantially flat upper surface region connected to one or both of the inner and outer surfaces by a lip or lips beneath said flat surface region.

15. A container according to claim 13, wherein, when the container body is closed by the closure, a first portion of said annular channel is in direct mechanical contact with said rim to limit exposure of the annular gasket to a volume enclosed by the container body.

16. A container according to claim 15, wherein a portion of the annular gasket is exposed to the volume enclosed by the container body, and a radial dimension of the exposed portion is less than 0.1 mm.

17. A container according to claim 13, wherein said annular gasket is formed of plastisol.

18. A container according to claim 13, wherein said annular gasket comprises a compression moulded thermoplastic elastomer.

19. A closure for closing the container body of claim 16, wherein, when the closure closes the container body, the annular channel is arranged to receive a rim of a neck of the container body such that the annular gasket forms a seal between the rim the said closure an inside radius of the annular gasket is greater than an inside radius of said rim.

* * * * *